United States Patent [19]

Fletcher, Jr. et al.

[11] 4,106,938

[45] Aug. 15, 1978

[54] VESICULAR COMPOSITION, ELEMENT AND PROCESS UTILIZING A DIOL

[75] Inventors: George Leland Fletcher, Jr.; Jonas Dedinas, both of Pittsford, N.Y.

[73] Assignee: Eastman Kodak Company, Rochester, N.Y.

[21] Appl. No.: 799,872

[22] Filed: May 23, 1977

[51] Int. Cl.[2] ..... G03C 1/52; G03C 1/00; G03C 5/24

[52] U.S. Cl. ..... 96/48 HD; 96/49; 96/88; 96/91 R; 96/91 D; 96/91 N; 96/75

[58] Field of Search ..... 96/88, 91 R, 48 HD, 96/49, 75, 91 D, 91 N

[56] References Cited

U.S. PATENT DOCUMENTS

| | | | |
|---|---|---|---|
| 2,699,392 | 1/1955 | Herrick et al. | 96/91 R |
| 2,703,756 | 3/1955 | Herrick et al. | 96/91 R |
| 3,355,295 | 11/1967 | Priest | 96/91 R |
| 3,841,874 | 10/1974 | Nichino | 96/91 R |
| 4,032,344 | 6/1977 | Fletcher et al. | 96/88 |

*Primary Examiner*—Won H. Louie, Jr.
*Attorney, Agent, or Firm*—Dana M. Schmidt

[57] ABSTRACT

A light-sensitive vesicular imaging composition is disclosed comprising a vesiculating agent which liberates gas upon exposure to activating radiation, a binder and a diol speed-increasing agent. The composition is coated as a thin film. Imagewise irradiation of the element causes gas to be released in the exposed areas. The composition, comprising gas entrapped in a thermoplastic matrix, can be heated to produce a visible record.

14 Claims, 5 Drawing Figures

VESICULAR COMPOSITION, ELEMENT AND PROCESS UTILIZING A DIOL

BACKGROUND OF THE INVENTION (1) Field of the Invention

The invention relates to a vesicular imaging composition and process, and to the imaging element used therein. In particular, it concerns an imaging element containing radiation-sensitive vesiculating agents within an appropriate matrix and with certain speed-increasing agents.

(2) State of the Prior Art

Vesicular imaging materials, such as films, are of considerable importance in information storage and retrieval, such as in microfilming, because of the extremely stable nature of the image. These materials are well known.

The first commercial vesicular matrices, hereinafter referred to as binders, were originally gelatin. Gelatin was replaced with improved binder materials due to the undesired tendency of gelatin to absorb moisture and therefore to cause a loss of image-forming bubbles and the destruction of the image. Typical improved materials included a great variety of synthetic polymers, such as poly(vinyl chloride), poly(vinylidene chloride), and polystyrene; and copolymers obtained by copolymerizing acrylonitrile with vinyl chloride, styrene, vinylidene chlorofluoride, or 1,1-difluoroethylene; by copolymerizing vinyl chloride with methyl acrylate, acrylic acid, diethyl maleate, or vinyl acetate; or by copolymerizing vinylidene chloride with vinyl chloride, vinyl acetate, vinyl alcohol, ethyl acrylate, or acrylonitrile. Examples of the homo- or co-polymerization of vinylidene chloride are described in U.S. Pat. No. 3,032,414, issued to R. James.

To be suitable, a binder must be sparingly permeable, so as to properly form vesicles from the gas released by the light-sensitive vesiculating agent. To assist in the proper formation of such vesicles, nucleating agents, such as stearic acid, have been added to increase the speed of the vesicular element, and in some cases, to decrease the contrast. Examples of such additions are disclosed in U.S. Pat. No. 3,355,295 issued Nov. 28, 1967, and in *Research Disclosure,* Vol. 127, November 1974, Publication No. 12709. Although stearic acid and wax nucleating agents contribute significantly to the speed of the element, they do have as a drawback a slight opacity.

Other nucleating techniques have been developed, but generally they require additional processing such as by steaming the element in water. Examples are disclosed in Kosar, *Light Sensitive Systems,* p. 279 (1965) and in Belgian Pat. No. 790,045 dated Feb. 1, 1973.

Patents relating only to the general background of vesicular elements include U.S. Pat. Nos. 3,779,774; 2,699,392; 2,703,756; and 3,149,971.

OBJECTS OF THE INVENTION

It is an object of the invention to provide a clear vesiculating composition and element providing increased speed, without the need for additional processing.

It is a related object of the invention to provide such a composition and element wherein the average contrast is no higher than that of compositions and elements formulated without the improvement of the invention.

Other objects and advantages will become apparent upon reference to the following Summary and Description of the Preferred Embodiments, when read in light of the attached drawings.

SUMMARY OF THE INVENTION

The invention concerns a clear vesiculating material wherein increased speed is achieved by adding to the material a novel speed-increasing agent comprising certain diols.

More specifically, it has been found according to the invention that increased speed can be provided with a vesicular imaging composition comprising, in admixture, a vesiculating agent capable of releasing a gas upon imagewise exposure to activating radiation, a water-insoluble, thermoplastic polymeric binder having a latent image stability period for said gas sufficient for vesicular imaging, and a diol capable of generating microscopic discontinuities in the binder when said element is formed as a coating and dried by heating at a first temperature less than about 100° C for a time sufficient to render the coating nontacky, and thereafter at a second, higher temperature between about 100° and about 200° C for less than about 30 seconds.

An element can be formed from such a composition, and comprises preferably a support, and coated on the support, the above-noted binder, vesiculating agent, and diol.

Such an element is used to form a visible image by imagewise exposing the element to activating radiation to provide a developable image and developing the resulting image by heating the element at a temperature and for a time sufficient to force the gas formed by the photo-decomposition of the agent to expand the binder into vesicles which form a visible image.

DESCRIPTION OF THE PREFERRED EMBODIMENTS

Figure 1:
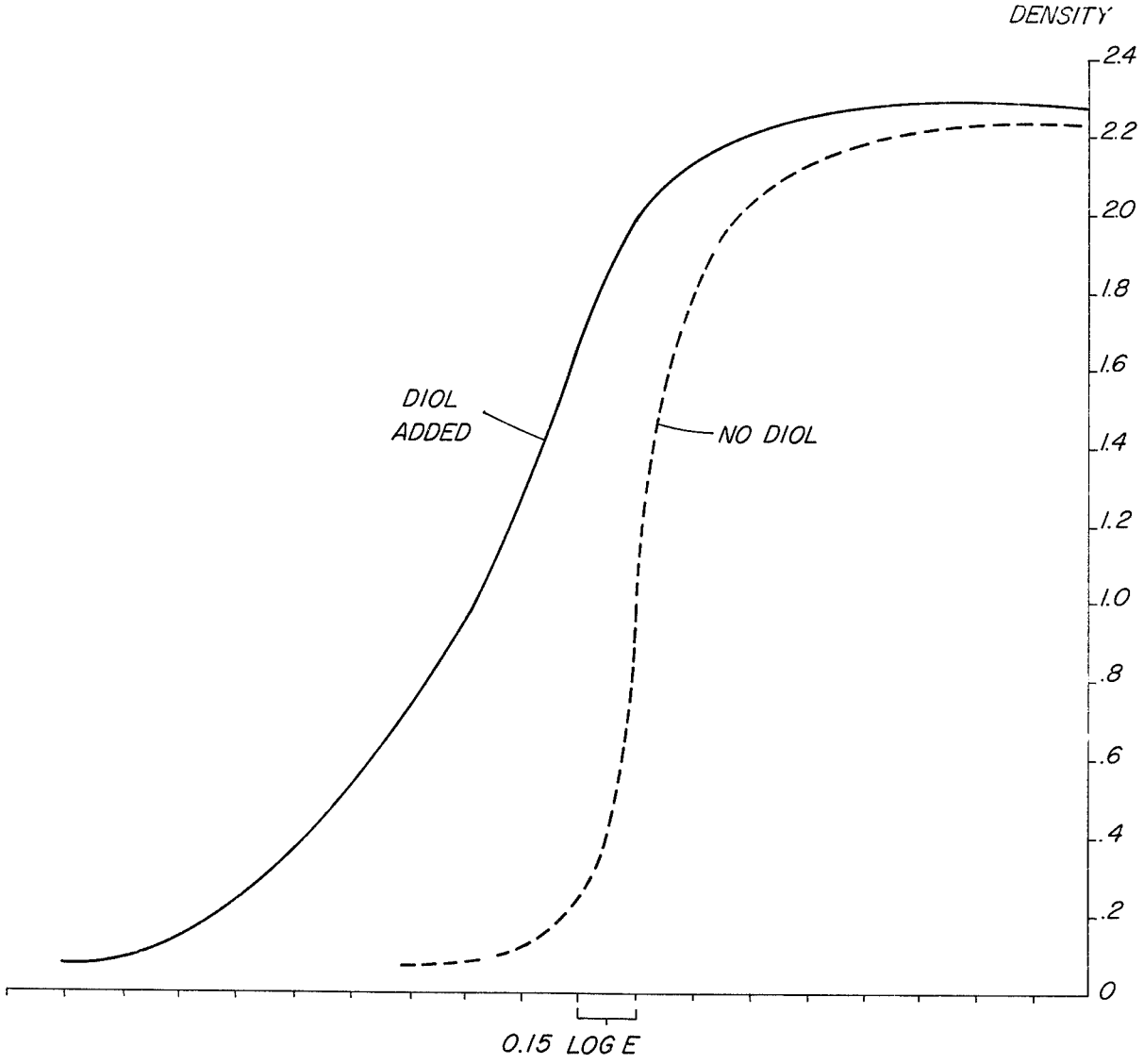
FIGS. 1–5 are graphs of optical density versus log exposure, developed for vesicular imaging elements prepared in accordance with the invention, contrasted with controls identically prepared and processed but without the speed-increasing agent.

It has been discovered that a certain class of diols, when distributed in a vesiculating composition act to increase the speed while maintaining or reducing the average contrast, compared to the same composition lacking the diols. The vesiculating composition thus comprises, in admixture, a water-insoluble, thermoplastic polymeric binder having a gas impermeability appropriate for vesiculating elements, a vesiculating agent capable of releasing a vesicle-forming gas upon exposure to activating radiation, and a diol speed-increasing agent as described.

As used herein, "in admixture" or "distributed" means either dispersed, dissolved, or otherwise intermixed, depending upon the solubility of the agent in the binder of choice.

The diols used in the composition of the invention are aromatic diols, which as used herein include certain aliphatic diols tetra-substituted with aryl radicals or benzyl radicals each of which in turn may bear one or more substituents that do not adversely affect the desired increase in speed as described. Highly preferred aromatic diols include benzopinacol and certain substituted benzopinacols found to provide the desired results. Included as substituted benzopinacols are 1,2-diphenyl-1,2-dibenzylethanediol; 1,2-diphenyl-1,2-bis(2-fluorophenyl)ethanediol; 1,1,2,2-tetra(4-chlorophenyl-)ethanediol; 1,2-diphenyl-1,2-bis(4-methylphenyl)ethanediol; 1,2-diphenyl-1,2-bis-(2-naphthyl)ethanediol; 1,2-bis(2,4-dichlorophenyl)-1,2-bis(4-chlorophenyl)ethanediol; 1,2-bis(2,4-dichlorophenyl)-1,2-bis(3,4-dichlorophenyl)ethandiol; and 1,2-diphenyl-1,2-bis(4-chlorophenyl)ethanediol. Combinations of these diols can also be used. It is further contemplated that equivalent nucleating agents comprise substituted benzopinacols wherein the substituents are the following: chlorine in the 2 and 4 positions on all four phenyl groups, fluorine in the 4 position on at least two phenyl groups, and fused aromatic rings to create naphthylene moieties for all four aromatic groups.

Mechanism

Although an explanation of the mechanism is not necessary to the use of the invention and not all details are known, it is believed that the speed-increasing agents herein described function physically as nucleating agents. That is, during the heating step used to drive solvent from the coated element, the agent appears to dehydrate to some extent, creating latent vesicles in the form of microscopic discontinuities, or bubbles, of water vapor. Such latent vesicles appear to act as nuclear sites for the gas imagewise released by the vesiculating agent by subsequent exposure. This theory is supported by the fact that coatings made with the nucleating agent, but without a vesiculating agent, become "cloudy" when heated under the conditions herein described. This "cloudy" condition is in fact a visual indication of the presence of the microscopic discontinuities. The cloudy condition, as well as the speed increase, can be destroyed by severe heating such as would collapse these sites.

In view of the described mechanism it is not surprising that variations in the manner in which the manufactured element is dried will produce slight variations in the photographic speed. That is, it has been found possible to increase the speed of the nucleated element of the invention as much as 0.30 log E merely by selecting certain flash-drying conditions. Although it is not clear what the optimum conditions are in each instance, the preferred manufacturing sequence is one in which the element is coated from solution onto a support and is dried first by mildly heating at a temperature of less than about 100° C until nontacky, usually requiring a drying time of from about two to about fifteen minutes, followed by flash-drying at a higher temperature between about 100° and about 200° C for less than about 30 seconds. Preferably the second heating is at a temperature of 150° C for at least about 3 seconds. It is the production of microscopic discontinuities in the coating during this drying sequence which provides a useful test for determining whether a particular aromatic diol is capable of functioning as a speed-increasing agent in accordance with the invention.

Even if the second flash-drying step between 100° and 200° C is omitted, an increase in speed is obtained with the use of the speed-increasing agents of the invention compared to a control lacking that agent.

Unless the above procedure is specifically referred to in detail, as used herein "dried" means simply the removal by any procedure of all but residual solvent until the coating is nontacky.

Although other nucleating techniques are not necessary, conventional nucleating agents such as stearic acid produce a speed increase in their own right when added to the composition forming the element of the invention. This increase is additive; therefore, higher speed is obtained by including these nucleating agents in the element of this invention. Such conventional agents are described, for example, in *Research Disclosure* Vol. 127, November 1974, Publication No. 12709.

With respect to the binders of the vesicular imaging element, especially useful binder polymers include homopolymers and copolymers of alpha-chloroacrylonitrile and blends or mixtures of such homopolymers with other water-insoluble polymers, such as are disclosed for example in U.S. Pat. No. 3,620,743; copolymers and terepolymers of vinylidene chloride, such as poly(-vinylidene chloride-co-acrylic acid-co-acrylonitrile); poly(vinyl chloride); poly(4-vinylpyridine); polystyrene; copolymers obtained by copolymerizing acrylonitrile with vinyl chloride, styrene, vinylidene chlorofluoride, or 1,1-difluoroethylene; by copolymerizing vinyl chloride with methyl acrylate, acrylic acid, diethyl maleate, or vinyl acetate; or by copolymerizing vinylidene chloride with vinyl chloride, vinyl acetate, vinyl alcohol, ethyl acrylate, or acrylonitrile; and bisphenol A/epichlorohydrin copolymers. Bisphenol A as used herein means 4,4'-isopropylidenediphenol, sometimes identified as 2,2-(p-hydroxyphenyl)propane.

Still other highly preferred examples of such useful polymers include polysulfonamides containing as a portion of the polymer backbone or as a pendant moiety, the group $>N—SO_2—$, and having a wavelength of maximum absorption, $\lambda_{max}$, which is no greater than about 350 nm in the spectral range of 200-750 nm when measured in solution with either ethanol or methoxyethanol. Particularly useful classes of such polymers include polymers containing toluene-2,4-disulfonamide units and those containing N-(vinylphenyl)sulfonamide units. Such binders can be homopolymers, copolymers or physical mixtures of the same. Whether the polymer is an addition polymer or a condensation polymer, a certain portion of the polymer should be recurring sulfonamide groups so that the weight percent of sulfur is at least about 4%. Other details concerning these poly(-sulfonamide) binders, and their methods of preparation, are disclosed in *Research Disclosure,* Vol. 131, Publication No. 13107, March 1975, the details of which are expressly incorporated herein by reference.

Yet another useful class of such polysulfonamide binders includes the class having the general formula:

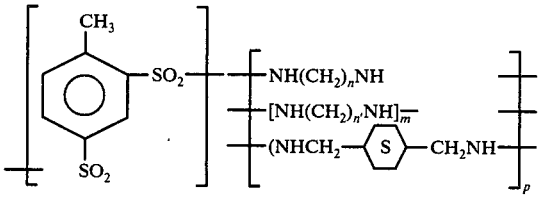

wherein $n$ and $n'$ are the same or different and are each a positive integer from 2 to 12; $m$ is 0 or 1; and $p$ is 0 when $m$ is 1, and is 1 when $m$ is 0.

It has been found that the binders discussed above have an impermeability to commonly-used vesiculating gases conducive to development of a latent image formed from exposure to activating radiation. Specifically, such binders either have or are contemplated as being capable of providing a latent image stability period that is substantially greater than about 1 minute, when coated as an element having a dried thickness of the binder which is between about 6 and about 15 microns and a vesiculating agent concentration of about 10% by dry weight of the composition. Such a latent image stability period has been found to be a measure of the gas impermeability. As used herein, "latent image stability period" is the length of time the gas, generated by the exposure steps described hereafter, and necessary to form an image during development, requires to diffuse out of the element when stored at 22° C to the point that no image greater than a density of 0.2 is developable. A useful test for making this determination comprises subjecting a candidate element, when fully manufactured with a dried binder thickness calculated to be between about 6 microns and about 15 microns, to the steps of (a) exposing the element for 18 seconds at ambient temperature, through a carbon step wedge to an undoped mercury arc lamp at a distance of about 7.6 cm, (b) storing the exposed element at 22° C for various periods of time, and (c) developing the stored element by contacting it with an aluminum block at 145° C for 3 seconds to ascertain whether a developable image is left. The storage time necessary to produce no developable image of a density greater than 0.2 is the latent image stability period. Highly preferred are those binders in which the gas impermeability for $N_2$, or carbon monoxide produced by cyclopropenones, is such that the latent image stability period, under the test conditions noted, is equal to or greater than about 30 minutes. Specifically, it has been found that, using the above-described test, the latent image stability period for $N_2$ in poly(ethylene-co-1,4-cyclohexylenedimethylenetoluene-2,4-disulfonamide), one of the preferred binders of the element of this invention, is 132 minutes. This binder has a latent image period for CO which is 44 minutes. These latent image stability periods compare with an essentially zero latent image stability period that was found when the same test was run using cellulose acetate butyrate, a polymer unsuited for vesicular imaging.

It will be further appreciated that some factors can alter slightly the actual numerical values of the stability period. One such factor, at least for polymers having polar sites, is the amount of residual solvent present in the polymer.

With respect to the vesiculating agents, any compounds which release gas upon exposure to activating radiation can be used. Typical examples are those which release nitrogen, as in the case of diazonium salts, azides, and carbazido compounds, and those which release carbon monoxide as in the case of cyclopropenones. In the former category are 4-(diethylamino)benzenediazonium fluoroborate; 1,4-dicarbazidobenzene; 2-carbazido-α-naphthol; 2,5-dimethoxy-4-morpholinobenzenediazonium hexafluorophosphate; 4-methylaminobenzenediazonium, 4-dimethylaminobenzenediazonium and 4-diethylaminobenzenediazonium chlorozincate; 4-phenylaminobenzenediazonium sulfate; N,N-dimethylbenzenediazonium fluoroborate; 4-(N-ethyl-N-hydroxyethylamino)benzenediazonium tetrachlorozincate; 1-diazo-2-hydroxynaphthalene-4-sulfonate; 4-benzoylamino-2,5-diethoxybenzenediazonium chloride; 4-cyclohexylamino-3-methoxybenzenediazonium-p-chlorobenzene sulfonate; 7-dimethylamino-8-methoxy-3-oxodihydro-1,4-thiazine-6-diazonium chloride; 4-dimethylamino-1-naphthalenediazonium fluoroborate; 3-oxo-7-dialkylaminobenzothiazine diazonium fluoroborate; 1-carbazido-2,5-dihydroxybenzene; 2-amino-1-carbazidobenzene; 1,4-dicarbazido-2,3-dihydroxyfurane; p-diethylaminobenzenediazonium chloride; 4-dimethylaminonaphthalene-1-diazonium chloride; ethylene bis(4-azidobenzoate); 4-azidoacetophenone; 2,6-bis-(p-azodibenzylidene)-4-methylcyclohexanone; 2,4-diazido-6-methylpyrimidine; 4-azido-6-methyl-1,2,3,3a,7-pentaazaindene; 3- or 4-azidophthalic anhydride; and quinone diazides. All of these agents are so well known that further description of their photodecomposition process and use is unnecessary.

Cyclopropenone vesiculating agents are described and claimed in commonly-owned U.S. Application Ser. No. 739,774 filed on Nov. 8, 1976, entitled "Cyclopropenone Vesiculating Composition, Element and Process" by G. Fletcher et al. It has been found that cyclopropenones comprise a class of agents which provide outstanding vesiculating characteristics. To avoid the formation of colored cyclopropenones that affect the background of the image, $\lambda_{max}$ of such cyclopropenones, measured in ethanol between the spectral range of about 250 to about 650 nm, should be no greater than about 400 nm, where $\lambda_{max}$ is defined to mean the wavelength of maximum absorption of the compound.

Highly preferred cyclopropenones are those having the formula

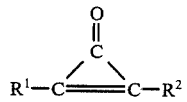

wherein:

$R^1$ and $R^2$ are the same or different and are each a substituted or unsubstituted aryl radical containing from 6 to 10 carbon atoms in the aromatic ring, such as, for example, phenyl and naphthyl; or an aralkenyl radical having 6 to 10 carbon atoms in the aryl portion and 1 to 5 carbon atoms in the alkenyl portion, for example 2,2-diphenylvinyl, 2-phenylvinyl, 2-naphthyvinyl and the like.

The substituents of each of the substituted aryl radical are one or more radicals selected from the group consisting of, in any position in the aryl ring:

(1) alkyl or alkoxy radicals containing from 1 to 5 carbon atoms, for example, methyl, ethyl, propyl, isopropyl, butyl, methoxy, ethoxy, propoxy, butoxy, and the like;

(2) a nitro radical;

(3) an aryloxy radical containing from 6 to 10 carbon atoms, for example phenoxy and naphthoxy and the like; and (4) a polymer to which the aryl radical is attached as a dependent moiety, the polymer having at least one repeating unit with the formula $-(R^3)-$ wherein $R^3$ is a lower alkylene radical containing from 1 to 5 carbon atoms, for example ethylene, propylene, and the like.

Thus $R^1$ and $R^2$ can each be any one of the formulas

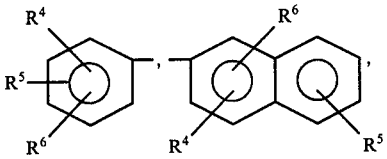

or $R^1$ or $R^2$ can be a polymer group having recurring units of the structure

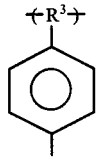

where $R^4$, $R^5$, and $R^6$ are the same or different and are the substituents defined immediately above as (1), (2) or (3), and $R^3$ is the repeating unit defined immediately above under (4).

The following representative cyclopropenones further illustrate this category of vesiculating agents, $\lambda_{max}$ being determined by measuring ultraviolet absorption peaks for each cyclopropenone in a Beckman model DB spectrophotometer after dissolving the polymer in spectrographic grade ethanol, and by visually examining the cyclopropenone coating to ascertain that no significant absorption occurs in the visible spectrum, i.e. in the range 400 nm to 750 nm:

2,3-diphenylcyclopropenone ($\lambda_{max}$ = 298),
2-(2-methoxynaphthyl)-3-phenylcyclopropenone ($\lambda_{max}$ = 371),
2-(2-methoxynaphthyl)-3-(4-methoxyphenyl)cyclopropenone ($\lambda_{max}$ = 372),
2,3-bis(2-methoxynaphthyl)cyclopropenone ($\lambda_{max}$ = 390),
2,3-bis(2,4-dimethylphenyl)cyclopropenone ($\lambda_{max}$ = 325),
2,3-bis(4-n-butoxyphenyl)cyclopropenone ($\lambda_{max}$ = 328),
2,3-bis(4-methoxyphenyl)cyclopropenone ($\lambda_{max}$ = 323),

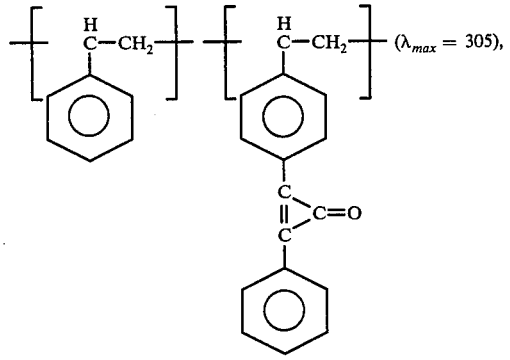

($\lambda_{max}$ = 305), 2,3-bis(4-phenoxyphenyl)cyclopropenone ($\lambda_{max}$ = 326),
2-(4-n-butoxyphenyl-3-phenylcyclopropenone ($\lambda_{max}$ = 318),
2-(2,5-dimethylphenyl)-3-phenylcyclopropenone ($\lambda_{max}$ = 302),
2-(4-methoxyphenyl-3-phenylcyclopropenone ($\lambda_{max}$ = 313),
2-(2,4-dimethoxyphenyl)-3-phenylcyclopropenone ($\lambda_{max}$ = 342),
2,3-bis(2,4-dimethoxyphenyl)cyclopropenone ($\lambda_{max}$ = 350),
2,3-bis(2-methyl-5-isopropylphenyl)cyclopropenone ($\lambda_{max}$ = 300),
2,3-bis(3-nitrophenyl)cyclopropenone ($\lambda_{max}$ = 297),
2,3-bis(2,5-dimethylphenyl)cyclopropenone ($\lambda_{max}$ = 325),
2,3-bis(4-methylphenyl)cyclopropenone ($\lambda_{max}$ = 310),
2-(2,4-dimethoxyphenyl)-3-(2,4-methylphenyl)cyclopropenone ($\lambda_{max}$ = 337),
2,3-bis(2,5-dimethoxyphenyl)cyclopropenone ($\lambda_{max}$ = 380),
2-(2,4,6-trimethylphenyl)-3-phenylcyclopropenone ($\lambda_{max}$ = 285),
2-phenyl-3-(2,5-dimethoxyphenyl)cyclopropenone ($\lambda_{max}$ = 366),
2-phenyl-3-(2,4-dimethylphenyl)cyclopropenone ($\lambda_{max}$ = 310), and
2,3-bis(2,2-diphenylvinyl)cyclopropenone ($\lambda_{max}$ = 374).

The above cyclopropenones can be prepared by known processes. The binders described for the other vesiculating agents are also useful with the cyclopropenones.

Any of these vesiculating agents can be used in concentrations of between about 1 and 15% of the weight of the binder.

The vesiculating layer can be coated onto a suitable support if the binder is not self-supporting when coated. Any suitable photographic support can be used in the practice of this invention. Typical supports include transparent supports, such as film supports and glass supports as well as opaque supports, such as metal and photographic paper supports. The support can be either rigid or flexible. The most common photographic supports for most applications are paper or film supports, such as poly(ethylene terephthalate) film. Suitable exemplary supports are disclosed in *Product Licensing Index,* Vol. 92, December 1971, Publication 9232, at page 108. The support can incorporate one or more subbing layers for the purpose of altering its surface properties so as to enhance the adhesion of the radiation-sensitive coating to the support. A typical example of a subbing material is the terpolymer of vinylidene chloride, acrylonitrile and acrylic acid.

Preparation

Benzopinacol and the substituted benzopinacol nucleating agents specifically listed above are known compounds readily available from conventional sources or can be prepared using known processes. Other benzopinacols meeting the discontinuity test during drying, outlined under "Mechanism" above, can be prepared by the following technique:

An amount of one or more ketones having the structure

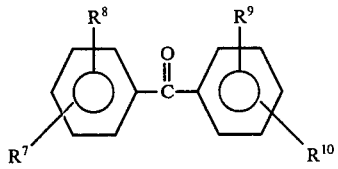

wherein $R^7$-$R^{10}$ are the same or different and are each hydrogen; a halogen such as Cl, F, Br and the like; an alkoxy containing from 1 to 5 carbon atoms, for example, methoxy, ethoxy and the like; or any other suitable substituent, including the necessary carbon atoms which when taken together with another of $R^7$-$R^{10}$ on the same phenyl ring complete an aromatic ring;

is dissolved in a solvent, such as ethanol or isopropanol to create a 0.1 to 0.5 molar solution.

The solution is irradiated with uv light under nitrogen atmosphere for the time necessary to effect conversion, which varies with the volume of sample being treated, the concentration of the ketone, the solvents selected, the intensity of the light, etc. Thereafter, most of the solvent is removed for example with a rotary-vacuum evaporator. Pure product is obtained by crystallization from the residual solvent. The photochemical synthesis of benzopinacol and substituted benzopinacols is described in the literature (Alexander Schönberg, *Preparative Organic Photochemistry,* Springer-Verlag New York, Inc. 1968, pages 204–205.)

As mentioned above, a preferred form of the invention is preferably an element formed by coating from a solvent. The coating is made on a support if the binder is not self-supporting. Conventional coating techniques can be used. The binder concentration in the solution can be between about 1% and about 30% by weight. The amount of aromatic diol to be added can be between about 1.3 and about 30% of the weight of the binder. Highly useful is a concentration of aromatic diol of from about 8 to about 13% of the binder weight.

Typically the solution is coated onto the support by such means as whirler coating, brushing, doctor-blade coating, hopper coating and the like, such as is described in *Product Licensing Index,* Vol. 92, December 1971, Publication No. 9232, at page 109. The amount of solids as coated should be between about 2 and about 20 $g/m^2$ of support. Multilayered elements, such as those described above with a suitable overcoat, can also be used.

The solvents for making the coating solutions will of course partly depend on the binder of choice. The diol and the vesiculating agent are either dissolved in the solvent, or dispersed throughout if they are not soluble therein. Preferred solvents include acetone and mixtures of acetone with methyl ethyl ketone or methoxyethanol. Some solvents may not be compatible and instead may interfere with the nucleating capability of the diol. In this category are high boiling solvents which act as plasticizers, or those which otherwise remove the water of dehydration produced when the diol is thermally decomposed during flash drying.

The coated element is preferably dried, as referred to above, by including a flash-drying step that exceeds 100° C for a relatively short period of time. The exact duration of such flash drying is not critical, except for optimum performance, but it does appear to vary depending upon the amount and type of binder used, and the amount and type of preheating used to render the coating nontacky.

The imaging element prepared as described above is imagewise exposed to activating radiation, that is, for instance ultraviolet light or visible light containing a strong ultraviolet component, such as is obtained from mercury arc lamps, to provide a developable image. Development is achieved by heating the exposed element for a time and at a temperature sufficient to force or expand the vesiculating gas released by the decomposed agent within the exposed portion, into visible vesicules. When the temperature of development is between about 90° and about 150° C, a few seconds of heating suffices. With at least some coating formulations, the higher development temperatures produce the greatest log E speed increase.

If desired, the unexposed portion of the element thereafter can be conventionally flash-exposed and stored at a temperature and for a time sufficient to allow the predominant weight portion of the gas generated by said brief exposure to diffuse out of the element. Typically storage can be for several hours at a temperature below 43° C.

The following examples further illustrate the preparation and use of the imaging element of the invention, incorporating the speed-increasing agents described above.

EXAMPLE 1

An amount of three-quarters of a gram of poly(α-chloroacrylonitrile) binder was dissolved in four grams of acetone by stirring at room temperature. To this solution was added 70 mg of 2,5-dimethoxy-4-(1-morpholino)benzenediazonium hexafluorophosphate light-sensitive vesiculator along with 75 mg of benzopinacol nucleating agent. After stirring at room temperature, the resultant clear lacquer solution was coated on 4 mil subbed poly(ethylene terephthate) film support at a wet coating thickness of 4 mils. The coating was dried to remove solvent by heating at about 66° C under a stream of air. Flash-drying was achieved by heating at 150° C for 3 seconds.

The photographic element so formed was then exposed to an undoped mercury arc lamp at a distance of 3 inches, through a carbon photographic step-wedge. The exposed film was processed to form the vesicular image by heating for 3 seconds at 128° C. A plot of the H and D standard curve obtained from the above film is shown in FIG. 1 compared to a similar film prepared without the diol sensitizer. The addition of the diol increased the speed by about 0.45 log E (at a density of 1.0) and reduced the gamma value or contrast from approximately 5.5 to approximately 2.0

EXAMPLE 2

Figure 2:
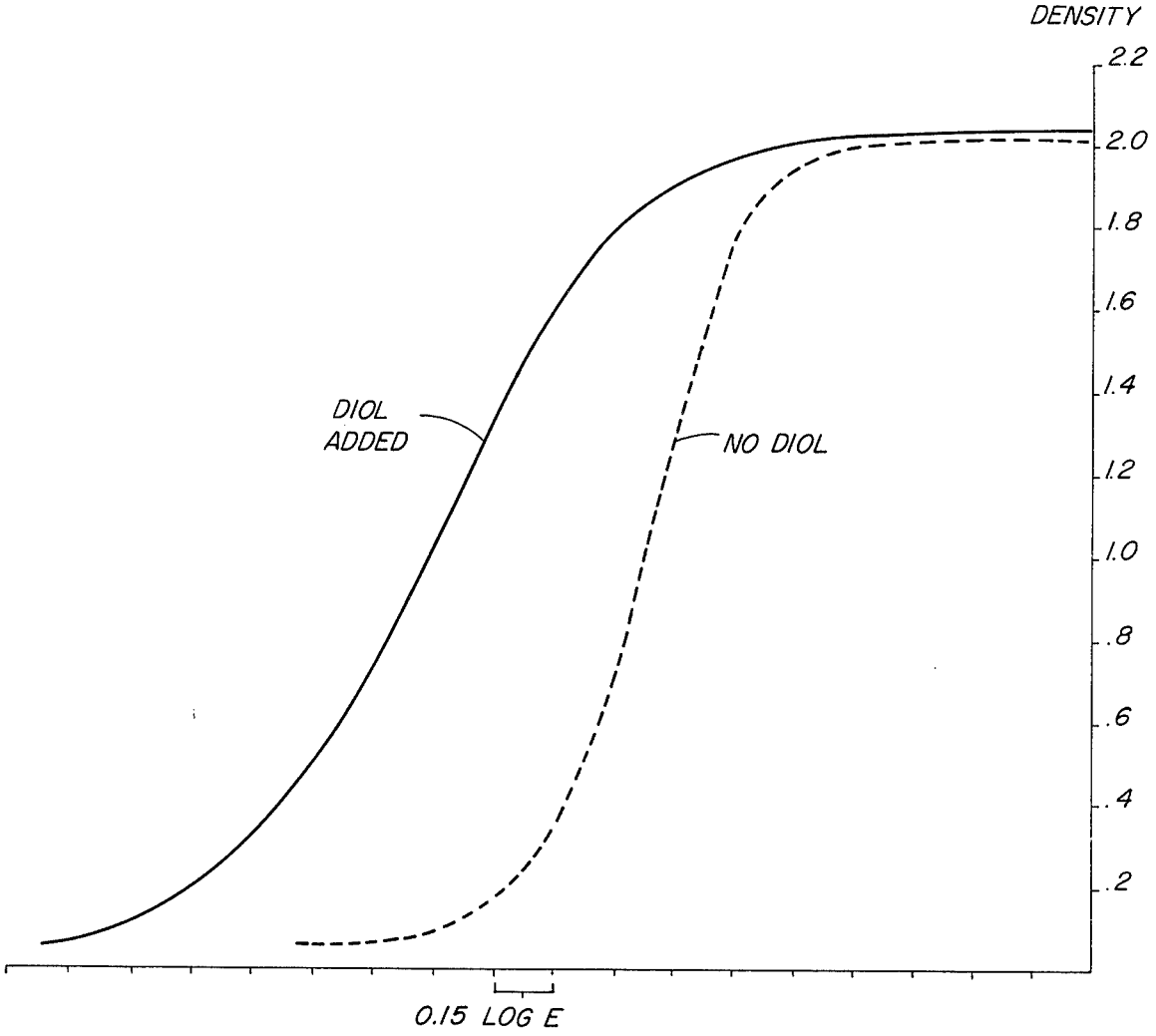

An amount of three-quarters of a gram of poly(ethylene-co-1,4-cyclohexylenedimethylenetoluene-2,4-disulfonamide) binder was dissolved in 4.0 grams of acetone and 2.0 grams of methoxyethanol, along with 75 mg of 2,5-dimethoxy-4-(1-morpholino)benzenediazonium hexafluorophosphate light-sensitive vesiculator and 100 mg of benzopinacol. A clear solution resulted by stirring and gentle heating. As described in Example 1, a vesicular coating was prepared, exposed and developed. The sensitometry of this material was compared to one prepared without the diol sensitizer. As shown in FIG. 2, the addition of the diol increased the speed by about 0.525 log E (at a density of 1.0) and reduced the gamma value from approximately 3.5 to approximately 2.0.

EXAMPLE 3

An amount of three-quarters of a gram of the polysulfonamide used in Example 2 was dissolved in 4.0 grams of acetone by gentle agitation at room temperature. The following solids were added to the clear lacquer solution and dissolved by continued stirring: (a) 75 mg of the vesiculator used in Example 2; (b) 100 mg of 1,2-diphenyl-1,2-dibenzylethanediol.

This lacquer solution was coated onto 4 mil subbed poly(ethylene terephthate) support using a 6 mil doctor blade, dried by passing air across the surface for 2 minutes at about 24° C, and flash dried for 5 seconds at 150° C.

As described in Example 1, the vesicular material was exposed and processed, and found to have a photographic speed 0.45 log E faster than a control coating prepared without the diol.

EXAMPLE 4

As described in Example 3, the polysulfonamide, vesiculator, and 100 mg of 1,1,2,2-tetra(4-chlorophenyl-)ethanediol were dissolved in solution. This lacquer solution was coated onto 4 mil subbed poly(ethylene terephthate) support using a 6 mil doctor blade and the coating was dried by passing air over the surface for several minutes at about 66° C. Flash-drying was omitted.

As described in Example 1, the vesicular material was exposed, processed, and found to have a speed 0.33 log E faster than a control coating prepared without the diol.

EXAMPLE 5

The procedures of Example 4 were repeated using 85 mg of 1,2-diphenyl-1,2-bis(2-fluorophenyl)ethanediol sensitizer. Results showed a speed increase of 0.40 log E over a control coating.

EXAMPLES 6–10

To demonstrate the speed increase possible with the other diols of the invention, imaging elements for each of these examples were prepared by dissolving three-quarters of a gram of poly-(ethylene-co-2,4-cyclohexylenedimethylenetoluene-2,4-disulfonamide) in four grams of acetone along with 75 mg of the vesiculating agent 2,5-dimethoxy-4-(1-morpholino)benzene diazonium hexafluorophosphate. A clear solution resulted by stirring at room temperature. Immediately before coating, the mole proportion of diol to be tested equivalent to 114 mg of benzopinacol was added to the polymer solution. When the diol was dissolved, the polymer solution was immediately coated on 4-mil subbed poly-(ethylene terephthalate) film support to a wet-laydown of 5 mils. The coating was dried on the coating block at 26.7° C for approximately three minutes and removed from the coating block and cut into strips.

The cut film strips were flash-dried by contacting the back of the coating to an aluminum heating block 150° C for between 5 and 10 seconds, the same time for each example. The heated film strips were observed by eye to be slightly hazy when an active diol was present. A control coating containing no diol was also identically prepared for each example and remained clear during the flash-heating step.

The flash heated film strips were exposed through a 0.15 log E step wedge in an IBM Model II Photocopier for 18 seconds and developed by heating through the back of the film to 128° C for 3 seconds. The density of the steps on the resulting wedge exposure was measured on a spectral densitometer. Density values were arranged on an H and D plot and the exposure required to give a density of 1.0 determined from the curve. This value was used to measure the relative film speed by comparing it with the control's value. Table I illustrates the log E speed increases for each example.

Table I

| Example | Diol | Log E Speed Increase |
|---|---|---|
| 6 | benzopinacol | 0.78 |
| 7 | 1,2-diphenyl-1,2-bis-(4-methylphenyl)-ethanediol | 0.25 |
| 8 | 1,2-diphenyl-1,2-bis-(2-naphthyl)-ethanediol | 0.28 |
| 9 | 1,2-bis(2,4-dichloro-phenyl)-1,2-bis(4-chlorophenyl)ethane-diol | 0.28 |
| 10 | 1,2-bis(2,4-dichloro-phenyl)-1,2-bis(3,4-dichlorophenyl)-ethanediol | 0.21 |

EXAMPLE 11

A polymer solution was prepared by stirring together at room temperature 0.750 g of poly-(ethyleneco-2,4-cyclohexylenedimethylenetoluene-2,4-disulfonamide), 75 mg of the vesiculating agent 2,5-dimethoxy-4-(1-morpholino)benzenediazonium hexafluorophosphate and 4.00 g of acetone. A clear solution resulted, which was coated after further dissolving in the solution 0.135 g of 1,2-diphenyl-1,2-bis(4-chlorophenyl)ethanediol by stirring at room temperature.

The coating, a 4 mil layer on a subbed poly(ethylene terephthalate) support, was dried by heating to 37.7° C for three minutes in a stream of air, and flash-dried by heating to 150° C for 13 seconds.

Figure 3:
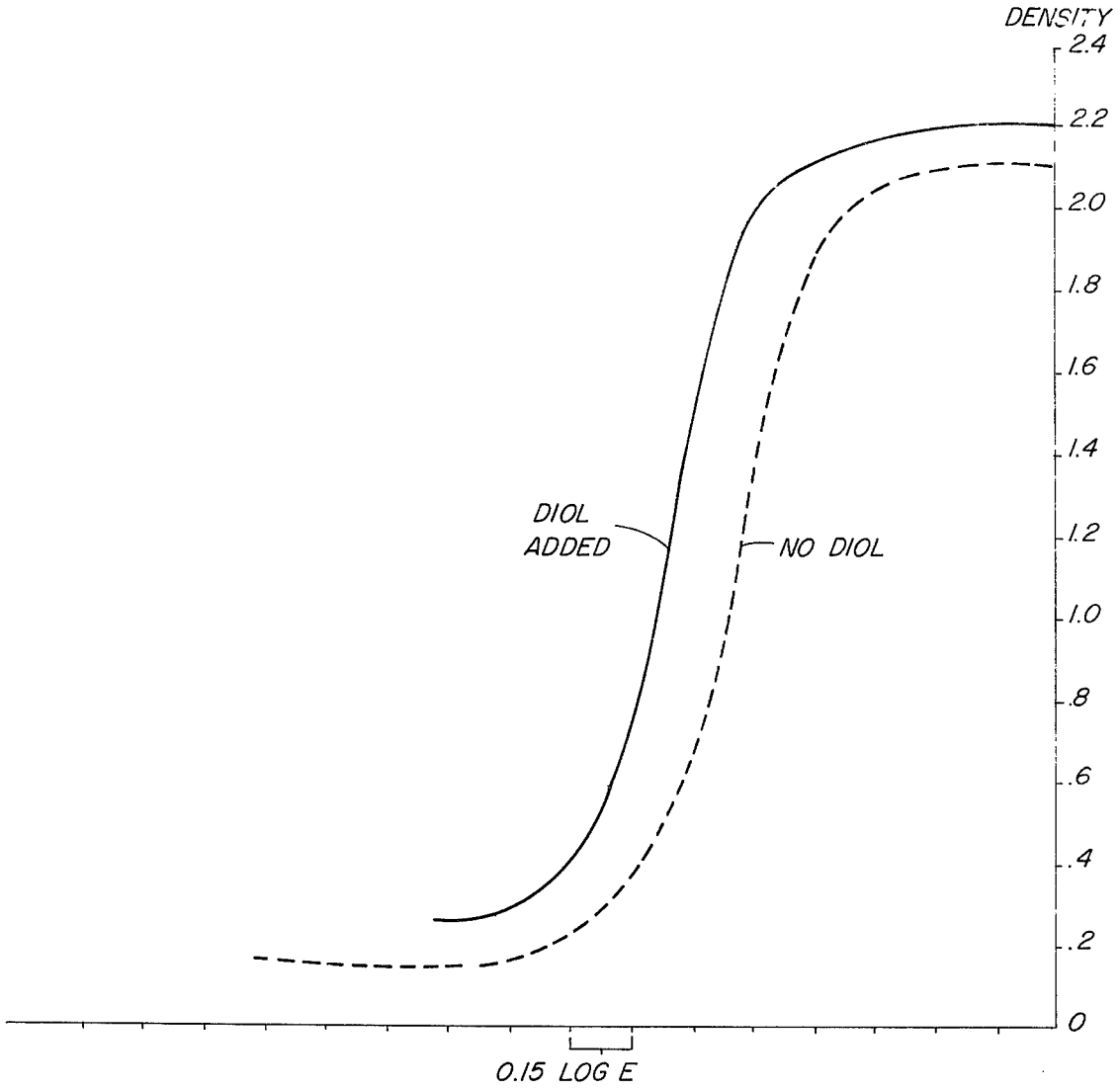

The vesicular element was exposed on an IBM model II D photocopier for 16 units of exposure through an 0.15 log E step tablet. The exposed film was then developed by heating to 128° C for 3 seconds. The exposure H and D curves for the films are shown in FIG. 3, compared to the same element identically prepared and exposed but without the diol. It can be observed from the curves that the film containing 4,4'-dichlorobenzopinacol is approximately 0.18 log E faster than the film containing no diol.

EXAMPLES 12 AND 13

Elements described in Example 2 were again prepared, except 0.114 g instead of 0.1 g of the nucleating agent was used and none was used in a control. In addition, Example 12 had 1% stearic acid added to it, measured as a percent by weight of total solids, whereas Example 13 had none. After exposure and development, Example 12 had, compared to the control, twice the amount of log E speed increases as did Example 13. All three had approximately the same average contrast.

EXAMPLES 14 AND 15

To demonstrate how different flash-drying conditions can alter the speed increase, Examples 14 and 15 were prepared, each with the following solution formula:

| | | |
|---|---|---|
| Binder(of Example 2) | 3.75 | g |
| Acetone | 20 | g |
| Diazonium salt (of Example 2) | 0.375 | g |
| Benzopinacol | 0.5 | g |

Each solution was wet-coated at 5 mils on a 4 mil subbed poly(ethylene terephthalate) support and gently dried by heating at 23.9° C for 5 minutes and then 43.3° C for 5 minutes. After flash-drying Example 14 at 150°

C for 8 seconds and Example 15 at 150° C for 20 seconds, exposure was made through a *3M Filmsort Uniprinter Model* 086 using a 250 watt mercury arc, and development was at 138° C for 2 seconds for both. In addition, identical control elements were prepared, exposed, and developed but without the diol.

Figure 4:
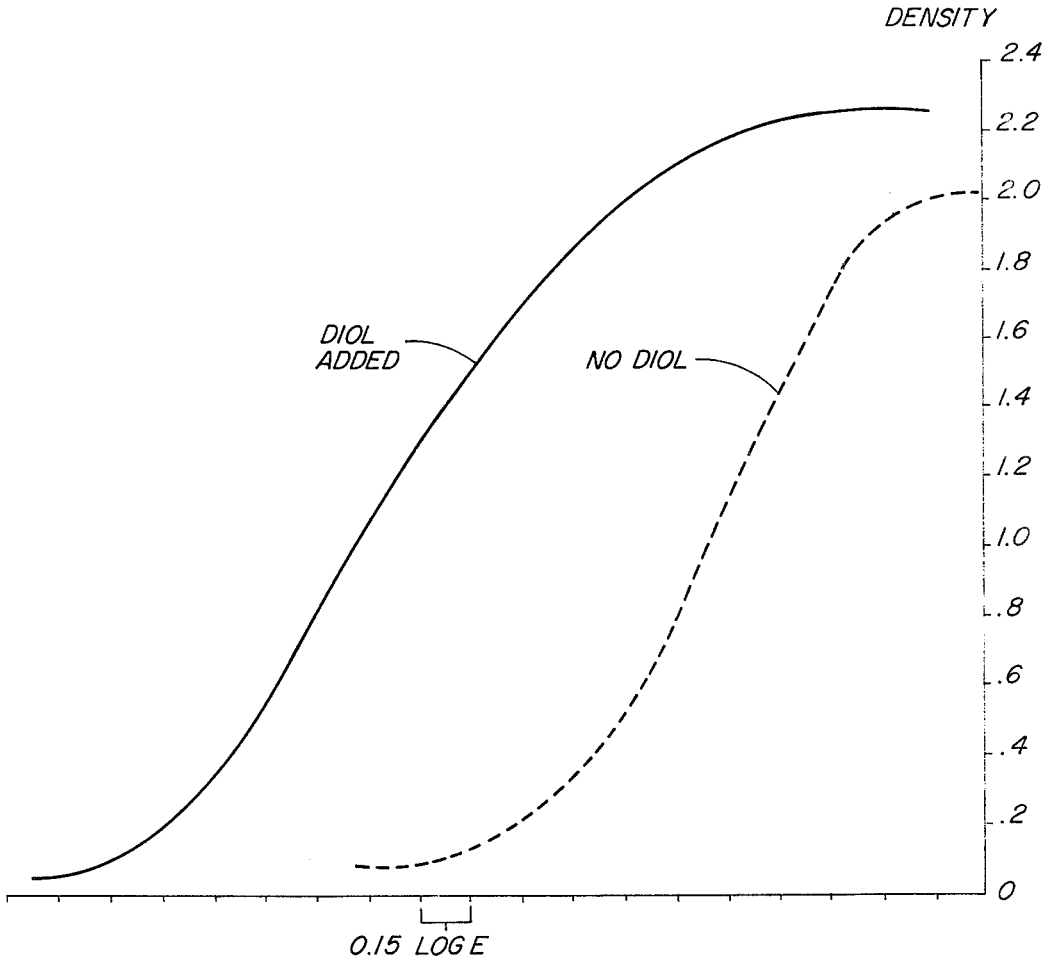
Figure 5:
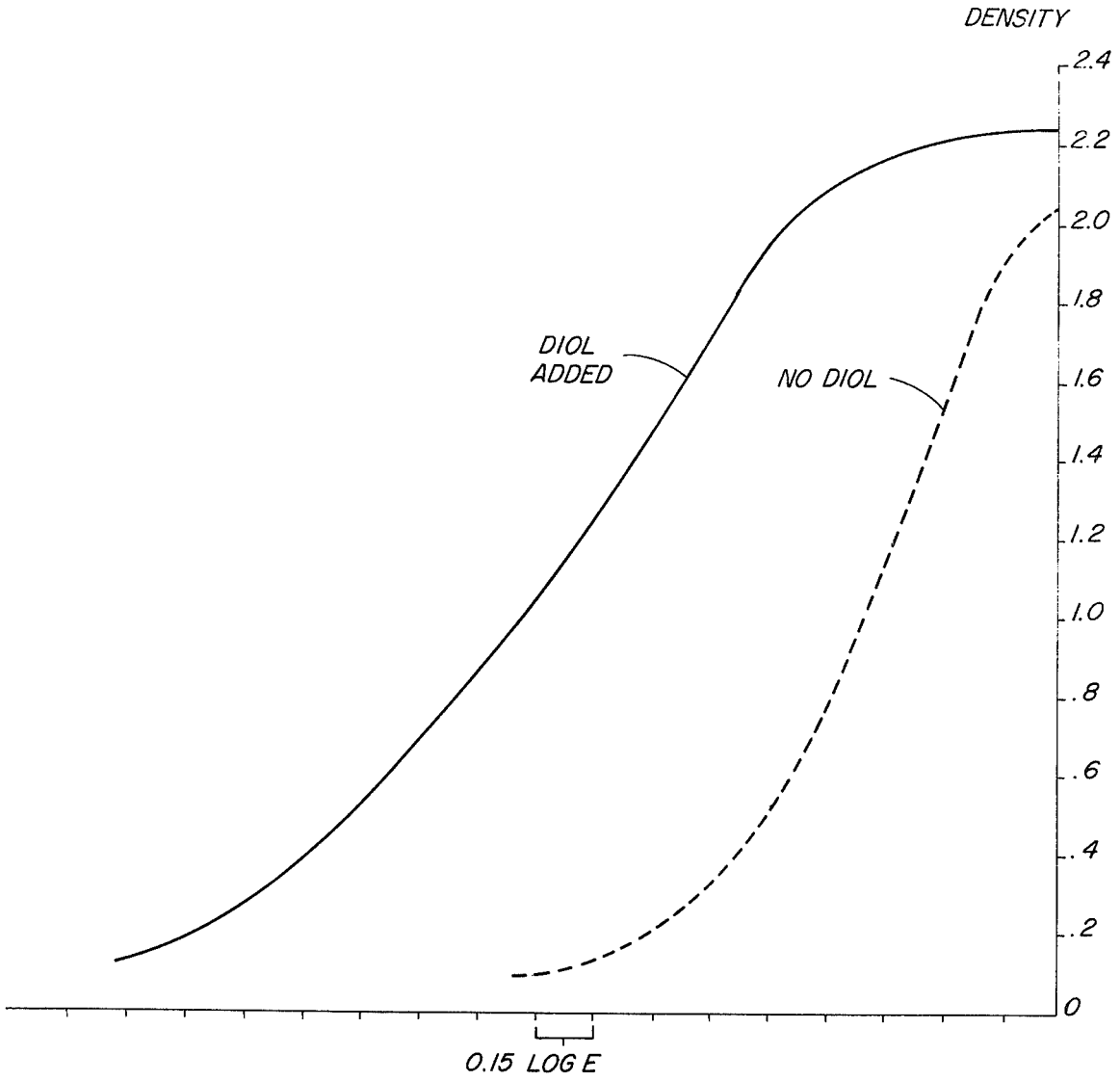

FIGS. 4 and 5 illustrate the H and D curves for Examples 14 and 15, respectively, compared with their controls. Whereas, in FIG. 4, the speed increase was 1.05 log E, the largest increase observed for the noted development conditions, in FIG. 5 for the identical element given a slightly longer flash-drying, the speed increase was 0.85 log E.

EXAMPLES 16 AND 17

When Examples 14 and 15 were repeated but with a slightly greater weight percent binder in the control, the 20 second flash-dried example, Example 17, had a greater speed increase over its control than did the 8 second dried example, Example 16.

Comparative Examples

The following Table II illustrates examples of diols found to generate no significant speed increase when added to a formulation and processed in a manner similar to those of the preceding examples. As used herein, "no significant speed increase" means no speed increase greater than 0.15 log E, as hand coating methods tend to produce experimental variations from coating to coating of up to that magnitude. These examples also demonstrated a lack of microscopic discontinuities as illustrated by a lack of a "cloudy" appearance, when dried as described above under "Mechanism."

Table II

| Comparative Examples | |
|---|---|
| 1 | Phenyl-1,2-ethanediol |
| 2 | 1,2,4-Butanediol |
| 3 | 3-(p-Chlorophenoxy)-1,2-propanediol |
| 4 | 3-Chloro-1,2-propanediol |
| 5 | 3-Acetoxy-1,2-propanediol |
| 6 | 4,5-Diphenyl-4,5-dihydroxysuberic acid (i.e. octanedioic) |
| 7 | 1,2-Bis(4-pyridyl)-1,2-ethanediol |
| 8 | 2,3-Diphenyl-2,3-butanediol |
| 9 | 1,2-Bis(2-indanyl)-1,2-diphenyl-1,2-ethanediol |
| 10 | 9,9'-Dihydroxy-9,9'-bixanthene |
| 11 | 1,2-Diphenyl-1,2-(4-pyridyl)-1,2-ethanediol |
| 12 | 1,2-Bis(4-dimethylaminophenyl)-1,2-(4-pyridyl)-1,2-ethanediol |
| 13 | 2,3-Bis(4-pyridyl)-2,3-butanediol |
| 14 | 1,2-Diphenyl-1,2-bis(3-hydroxyphenyl)-ethane diol |

The invention has been described in detail with particular reference to certain preferred embodiments thereof, but it will be understood that variations and modifications can be effected within the spirit and scope of the invention.

What is claimed is:

1. A vesicular imaging composition comprising, in admixture, a vesiculating agent capable of releasing a gas upon imagewise exposure to activating radiation, a water-insoluble, thermoplastic polymeric binder having a latent image stability period for said gas sufficient for vesicular imaging, and a diol capable of generating microscopic discontinuities in the binder when said element is formed as a coating and dried by heating at a first temperature less than about 100° C for a time sufficient to render the coating nontacky, and thereafter at a second, higher temperature between about 100° and about 200° C for less than about 30 seconds.

2. A composition as defined in claim 1, wherein said diol is benzopinacol.

3. A composition as defined in claim 1, wherein said diol is 1,2-dibenzyl-1,2-diphenylethylene glycol.

4. A composition as defined in claim 1, wherein said diol is 1,2-diphenyl-1,2-bis(2-fluorophenyl)ethanediol.

5. A composition as defined in claim 1, wherein said diol is 1,1,2,2-tetra(4-chlorophenyl)ethanediol.

6. A composition as defined in claim 1, wherein said vesiculating agent releases nitrogen upon exposure.

7. A composition as defined in claim 6, wherein said agent is 2,5-dimethoxy-4-(1-morpholino)benzenediazonium hexafluorophosphate and said diol is benzopinacol.

8. A composition as defined in claim 1, wherein said vesiculating agent releases carbon monoxide upon exposure.

9. A composition as defined in claim 1, wherein said diol is selected from the group consisting of benzopinacol; 1,2-diphenyl-1,2-dibenzylethanediol; 1,2-diphenyl-1,2-bis(2-fluorophenyl)ethanediol; 1,1,2,2-tetra(4-chlorophenyl)-ethanediol; 1,2-diphenyl-1,2-bis(4-methylphenyl)ethanediol; 1,2-diphenyl-1,2-bis(2-naphthyl)ethanediol; 1,2-bis-(2,4-dichlorophenyl)-1,2-bis(4-chlorophenyl)ethanediol; 1,2-bis-(2,4-dichlorophenyl)-1,2-bis(3,4-dichlorophenyl)-ethanediol; and 1,2-diphenyl-1,2-bis(4-chlorophenyl)ethanediol.

10. In a vesicular imaging element comprising a support;

coated on the support, in admixture, a vesiculating agent capable of releasing a gas upon imagewise exposure to activating radiation, a water-insoluble, thermoplastic polymeric binder having a latent image stability period for said gas sufficient for vesicular imaging, and a nucleating agent admixed with said binder;

the improvement wherein said nucleating agent is selected from the group consisting of benzopinacol; 1,2-diphenyl-1,2-dibenzylethanediol; 1,2-diphenyl-1,2-bis(2-fluorophenyl)ethanediol; 1,1,2,2-tetra(4-chlorophenyl)-ethanediol; 1,2-diphenyl-1,2-bis(4-methylphenyl)ethanediol; 1,2-diphenyl-1,2-bis(2-naphthyl)ethanediol; 1,2-bis-(2,4-dichlorophenyl)-1,2-bis(4-chlorophenyl)ethanediol; 1,2-bis-(2,4-dichlorophenyl)-1,2-bis(3,4-dichlorophenyl)-ethanediol; and 1,2-diphenyl-1,2-bis(4-chlorophenyl)ethanediol.

11. An imaging element as defined in claim 10, wherein said vesiculating agent releases nitrogen upon exposure.

12. An element as defined in claim 11, wherein said agent is 2,5-dimethoxy-4-(1-morpholino)benzenediazonium hexafluorophosphate.

13. An imaging element as defined in claim 10, wherein said vesiculating agent releases carbon monoxide upon exposure.

14. A dry process for forming a photographic image, comprising the steps of (a) imagewise exposing an element containing in admixture, a vesiculating agent capable of releasing a gas upon imagewise exposure to activating radiation, a water-insoluble, thermoplastic polymeric binder having a latent image stability period for said gas sufficient for vesicular imaging, and a nucleating agent selected from the group consisting of benzopinacol; 1,2-diphenyl-1,2-dibenzylethanediol; 1,2-diphenyl-1,2-bis(2-fluorophenyl)ethanediol; 1,1,2,2-tetra-(4-chlorophenyl)ethanediol; 1,2-diphenyl-1,2-bis(4-methylphenyl)ethanediol; 1,2-diphenyl-1,2-bis-(2-naphthyl)ethanediol; 1,2-bis(2,4-dichlorophenyl)-1,2-bis(4-chlorophenyl)ethanediol; 1,2-bis(2,4-dichlorophenyl)-1,2-bis(3,4-dichlorophenyl) ethanediol; and 1,2-diphenyl-1,2-bis(4-chlorophenyl)ethanediol; and (b) developing the exposed element by heating it at a temperature and for a time sufficient to force the gas formed by the photodecomposition of the agent to expand into vesicles which form a visible image.

* * * * *